US008845769B2

(12) United States Patent
Leveson

(10) Patent No.: US 8,845,769 B2
(45) Date of Patent: Sep. 30, 2014

(54) DOWNDRAFT GASIFIER WITH IMPROVED STABILITY

(75) Inventor: Philip D. Leveson, Sandy Springs, GA (US)

(73) Assignee: ZeroPoint Clean Tech, Inc., Potsdam, NY (US)

( * ) Notice: Subject to any disclaimer, the term of this patent is extended or adjusted under 35 U.S.C. 154(b) by 917 days.

(21) Appl. No.: 13/008,885

(22) Filed: Jan. 18, 2011

(65) Prior Publication Data

US 2012/0017510 A1 Jan. 26, 2012

Related U.S. Application Data

(60) Provisional application No. 61/296,155, filed on Jan. 19, 2010.

(51) Int. Cl.

| | |
|---|---|
| ***B01J 7/00*** | (2006.01) |
| ***F23B 50/06*** | (2006.01) |
| ***C10J 3/26*** | (2006.01) |
| ***C10J 3/32*** | (2006.01) |
| ***C10J 3/40*** | (2006.01) |
| ***F23H 1/00*** | (2006.01) |

(52) U.S. Cl.

CPC . *C10J 3/26* (2013.01); *F23B 50/06* (2013.01); *F23G 2900/50002* (2013.01); *F23G 2203/401* (2013.01); *C10J 3/32* (2013.01); *C10J 3/40* (2013.01); *F23H 1/00* (2013.01)

USPC ..... 48/61

(58) Field of Classification Search

CPC ..... C10J 3/24; C10J 3/26; C10J 3/30; C10J 3/32; C10J 3/34; C10J 3/36; C10J 3/38; C10J 3/40; C10J 3/42; C10J 2200/36; C01J 2200/09

See application file for complete search history.

(56) References Cited

U.S. PATENT DOCUMENTS

| | | | | |
|---|---|---|---|---|
| 4,137,051 | A * | 1/1979 | Godwin | 48/66 |
| 4,450,952 | A | 5/1984 | Steiner | |
| 4,453,949 | A | 6/1984 | Fasching | |
| 4,583,992 | A | 4/1986 | Rogers | |

(Continued)

FOREIGN PATENT DOCUMENTS

| | | | |
|---|---|---|---|
| DE | 208603 | C | 9/1907 |
| GB | 313 709 | A | 6/1929 |
| GB | 733 696 | A | 7/1955 |

OTHER PUBLICATIONS

International Searching Authority, European Patent Office, International Search Report, Application No. PCT/US2011/021769, European Patent Office, Patentlaan, Netherlands.

(Continued)

*Primary Examiner* — Imran Akram

(74) *Attorney, Agent, or Firm* — Allan W. Watts; Charles L. Warner; Bryan Cave LLP

(57) ABSTRACT

A downdraft gasifier (1) has an oxidant inlet (3), a biomass injector (2), a grate (9), a gas exit port (7), and an ash removal system (11). A sensor (10) maintains the height of the bed and a rotating paddle (5) maintains the top of the bed (4) at an even height. The grate arrangement (9) is preferably a sliding grate arrangement which actively moves ash material through the grate. An in-bed oxidant distributor (6) injects oxidant within the bed.

30 Claims, 5 Drawing Sheets

(56) References Cited

U.S. PATENT DOCUMENTS

| | | | | |
|---|---|---|---|---|
| 4,764,185 | A * | 8/1988 | Mayer | 48/76 |
| 5,230,716 | A * | 7/1993 | Notestein | 48/62 R |
| 2003/0196577 | A1 | 10/2003 | Lefcort | |
| 2004/0182294 | A1 * | 9/2004 | Hahn et al. | 110/347 |
| 2007/0006528 | A1 | 1/2007 | Diebold | |
| 2008/0148634 | A1 * | 6/2008 | Yu et al. | 48/77 |
| 2009/0158658 | A1 * | 6/2009 | Stadler et al. | 48/77 |
| 2010/0037519 | A1 * | 2/2010 | Patil et al. | 48/76 |
| 2010/0050515 | A1 * | 3/2010 | Wakefield et al. | 48/77 |
| 2012/0137582 | A1 * | 6/2012 | Graham et al. | 48/87 |

OTHER PUBLICATIONS

China State Intellectual Property Office, First Office Action of China State Intellectual Property Office, 100738.

European Office Action/Examination report (Jul. 30, 2014).

* cited by examiner

DOWNDRAFT GASIFIER WITH IMPROVED STABILITY

PRIORITY CLAIM

This patent application claims the priority of provisional patent application Ser. No. 61/296,155 entitled "Downdraft Gasifier With Improved Stability", filed Jan. 19, 2010, by Dr. Philip D. Leveson.

FIELD OF THE INVENTION

The present invention relates to the improved stability of downdraft gasifiers. Disclosed are techniques to level biomass at the top of the bed, to inject oxidant uniformly throughout the cross section of the bed, and to withdraw ash and char uniformly through the grate. These techniques can be used individually, or preferably, all in combination to provide a greatly improved gasifier stability and controllability.

BACKGROUND OF THE INVENTION

Downdraft gasifiers are well known and have been used for over 100 years. In the arrangement the biomass and oxidant both flow in a downward direction. The use of a downdraft gasifier results in a gas which is very low in tar concentration as the syngas passes through a char zone towards the lower section of the bed where significant tar destruction occurs. As the produced syngas requires minimal further clean up this type of gasifier has been found useful as an onboard gasifier for vehicle use during times of fuel shortages.

The downdraft gasifier also has a number of disadvantages. As the bed is supported on a grate it is possible for the biomass to plug the grate or bed, resulting in a non-even distribution (a maldistribution) of air through the bed, excessive pressure drop across the depth of the bed, and even the need to shut down the gasifier to clear the grate and the bed.

The biomass may also form bridges or channels, thereby forming low pressure drop "short-cuts" for the oxidant, which result in lower bed combustion, weak gas production and possibly increased rates of tar production.

Another problem is that the flame front can be difficult to stabilize. Depending on operating conditions, the flaming pyrolysis front may migrate to the top of the bed, resulting in unstable operation and/or upper combustion, again resulting in the need to shut down the system. One downdraft gasifier, namely, the Imbert design, overcomes this last problem through radial injection of oxidant only towards the lower bed. The flame front is thus naturally stabilized there—it cannot travel upwards due to a lack of oxidant above the point of injection. However, this technique lacks the ability to be scaled to higher throughputs due to a limitation in how far into the bed the radially directed jets can cause oxidant penetration. In effect, the upper sizing is dictated by how far the oxidant can penetrate into the bed.

SUMMARY OF THE INVENTION

Downdraft gasifiers and a special grate for downdraft gasifiers are disclosed.

One downdraft gasifier has a body, an air intake toward the top of the body to allow air into the body, a fuel feed inlet toward the top of the body to allow the controlled introduction of fuel into the gasifier, a grate located inside the body and below the fuel feed inlet to support a bed of the fuel, an in-bed air distribution system comprising a plurality of pipes with nozzles therein, located inside the body and above the grate, to inject air within the bed, a rotating paddle, located inside the body and above the grate, to stir the bed, a gas exit port located below the grate, and an ash removal port toward the bottom of the body.

Another downdraft gasifier has a body, an air intake toward the top of the body to allow air into the body, a fuel feed inlet located toward the top of the body to allow the introduction of fuel into the gasifier, an air inlet located toward the top of the body to allow the introduction of air into the gasifier, and a special grate located inside the body and below the fuel feed inlet and the air inlet to support a bed of the fuel, a motor to move a specified part of the grate in a specified manner, a rotating paddle, located inside the body and above the grate, to stir the bed, a gas exit port located below the grate, and an ash removal port toward the bottom of the body.

The special grate has: (1) a plurality of substantially parallel elongate plate sections, each plate section having an elongate dimension and comprising a horizontal component and a vertical component, the vertical component being substantially centered on the horizontal component, the horizontal components being separated from each other by a first predetermined distance, the vertical components being separated from each other by a second predetermined distance, and the elongate dimension of the plate sections being oriented in a first predetermined direction, (2) a spacer to surround the plate sections, and joined to the plate sections, to form a plate structure, (3) a plurality of substantially parallel elongate canopy sections, each canopy section having an elongate dimension and having a predetermined shape, the canopy sections being separated from each other by a third predetermined distance at the top of the predetermined shape and being separated from each other by a fourth predetermined distance at the bottom of the predetermined shape, the elongate dimension of the canopy sections also being oriented in said first predetermined direction, and (4) a plurality of bars joined to the canopy sections to form a canopy structure. The canopy structure being directly above the plate structure. A motor moves the predetermined one of said canopy structure or said plate structure in a direction substantially perpendicular to said first predetermined direction, the other structure of said canopy structure or said plate structure is fixed in place.

The stability of a downdraft gasifier is thus dramatically improved and the gasifier systems have substantially higher energy output rates than those of traditional gasifier designs. A more even bed and air flow are produced, and the gasification process occurs in a similar manner throughout the full cross sectional area of the gasifier bed.

The upper paddle evenly distributes biomass across the entire cross sectional area of the gasifier bed, an in-bed oxidant distributor with a plurality of oxidant injection nozzles supplies oxidant throughout the entire cross sectional area of the bed, and an active grate mechanism allows a metered withdrawal of the lower level ash char mixture from the bed.

The various improvements disclosed herein can be used individually or in combination.

BRIEF DESCRIPTION OF THE DRAWINGS

The above-mentioned and other features and advantages of this invention, and the manner of attaining them, will become apparent and be better understood by reference to the following description of several embodiments of the invention in conjunction with the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION OF THE INVENTION

Figure 1:
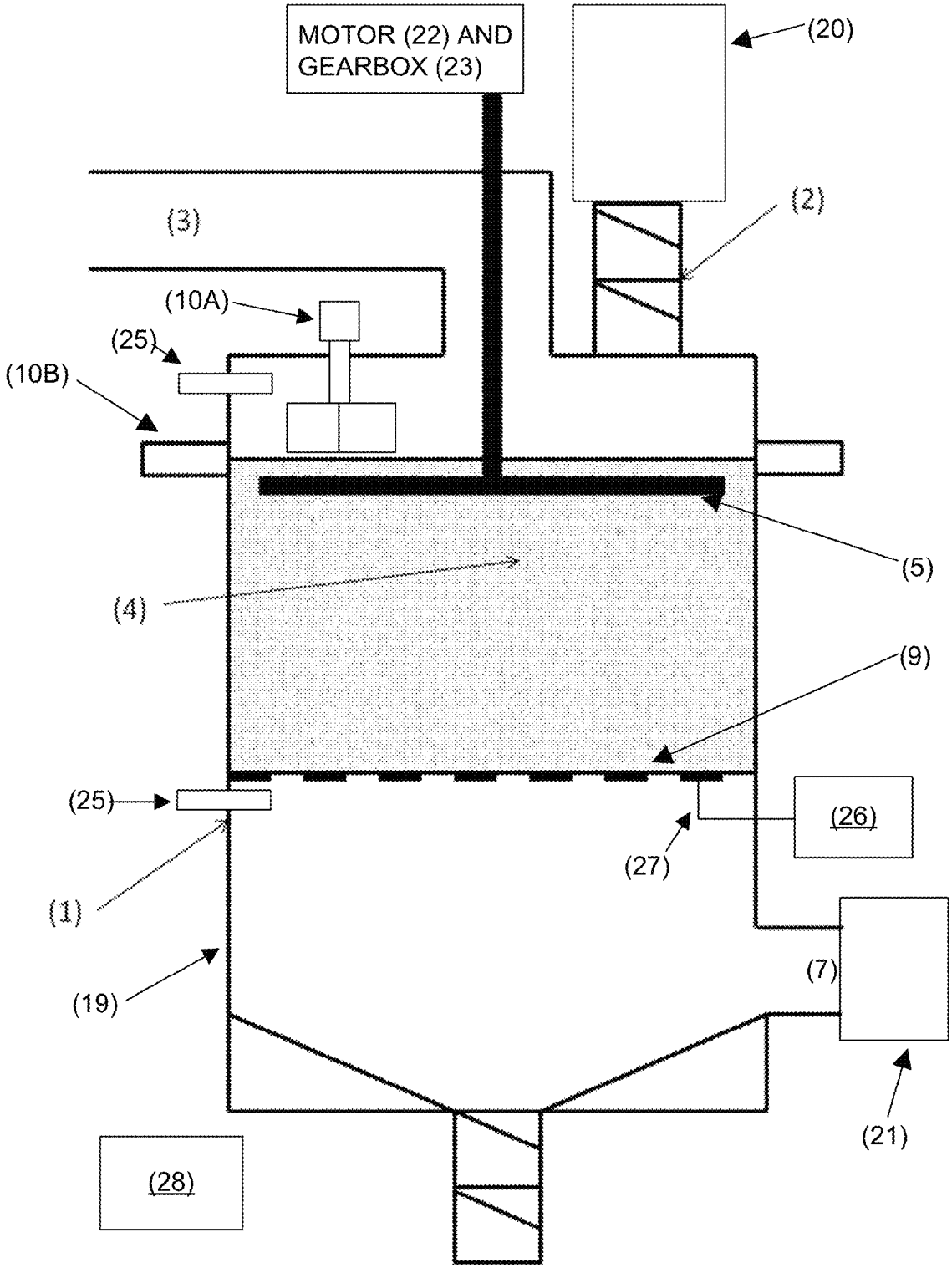
FIG. 1 is a schematic of a downdraft gasifier, utilizing twin flap valves for biomass feed and a top paddle.

An upper paddle evenly distributes biomass across the entire cross sectional area of the gasifier bed, an in-bed oxidant distributor with a plurality of oxidant injection nozzles supplies oxidant throughout the entire cross sectional area of the bed, and an active grate mechanism allows a metered withdrawal of the lower level ash char mixture from the bed.

A more even bed and air flow are thus produced, and the gasification process occurs in a similar manner throughout the full cross sectional area of the gasifier bed. As a result, the stability of a downdraft gasifier is dramatically improved, and the gasifier has a substantially higher energy output rate than those of traditional design.

In a downdraft gasifier both the oxidant and biomass travel in a downward direction. Often the biomass is supported on a porous grate which supports the biomass bed whilst allowing smaller particles of char and ash as well as the produced syngas to pass from the gasification chamber into a lower chamber. The technique produces a syngas with lower tar concentrations than other updraft, sidedraft or fluidized bed arrangements. This is due to a hot char reduction zone being present towards the lower section of the bed and wherein significant tar destruction reactions occur.

For a downdraft gasifier to operate with optimum or near optimum performance and with improved stability the gasifier bed must be operating with similar heat and mass transfer and kinetic characteristics throughout the entire cross section of the bed. This occurs when:

(i) The pressure drop from the top of the bed to the bottom of the bed is the same throughout the entire cross section of the bed;

(ii) The height of the bed is the same everywhere;

(iii) The flame is stabilized within the bed;

(iv) The air is distributed in such a way that each cross sectional area of the bed receives the same volumetric flow rate of oxidant; and (v) Any baffling or outlet piping below the grate does not promote preferential flow within the bed.

As previously mentioned, one cause of instability and non-optimum gasifier performance can result from a maldistribution of airflow through the gasifier bed. This is particularly important when airflow enters the gasification unit above the bed. The Ergun equation can be used to predict pressure drop across a packed bed. In the equation it can be seen that the pressure drop is directly proportional to the bed height, where the bed height is defined as the height from the grate level to the top of the biomass. If part of the bed is slightly lower than the surrounding bed air flow will preferentially be through the bed at the low spot. The localized increased air flow will promote faster kinetics in that region, thus increasing the rate of biomass consumption in the cross sectional area where the low point exists. This will then result in the bed falling more rapidly there, causing the low point to become even lower. This results in a positive feedback cycle and is the initiation point of the formation of channels within the bed. Maldistribution of air can result in higher carbon dioxide production rates and higher localized temperatures within the cross sectional area containing the channel.

FIG. 1 is a schematic of a stratified downdraft gasifier with an upper rotating paddle installed. The gasifier has a body or shell, generally designated as (19). In the gasifier (1) depicted in FIG. 1, a twin flap valve (2) arrangement performs as a fuel feed inlet which is used to feed biomass to the system whilst providing an air lock to prevent air entering or syngas leaving the system via this route. A number of different types of feedstock feeding apparatus can be used, including, but not limited to, rotary valves, augers, slide gate valves or pneumatic feed systems. The figure also contains an above bed central oxidant inlet (3). A number of different inlet arrangements are possible, including side inlets, above bed oxidant distributors (which evenly distribute the oxidant into the headspace above the bed), and in-bed oxidant distributors (which evenly distribute the oxidant directly into the bed at some height above the grate). Biomass is fed into the gasifier bed (4) via the twin flap valve arrangement (2). A metered amount of biomass is initially fed to the hopper (20) above the top flap valve. Once the desired amount is fed the top valve opens and the biomass enters the cavity between the valves. Once the top valve is closed the bottom valve opens and the biomass drops into the gasifier bed. The feed tends to dump into a localized zone below the discharge point of the bottom valve. In this case, the rotating paddle (5) acts to distribute the biomass evenly across the entire cross section of the bed. As the paddle redistributes the biomass at the top of the bed any low points or dips within the bed are continuously filled. Maintaining an even bed height across the entire cross sections promotes even air distribution thus minimizing the probability of instabilities described above.

Example 1

A 50" inner diameter (ID) stratified gasifier with off center 12" twin flap valves for biomass addition and a 6" central air oxidant inlet was used to gasify ¼" outer diameter (OD) wood pellets. A tangential laser system (10B) was used to indicate bed height and set to maintain the bed height at 24" from the top of the grate (9) to the top of the bed. A laser system is not preferred because dust created when new material is added may temporarily give an erroneous height indication. Preferably, an infrared or microwave sensor would be used. Even more preferably, a rotary paddle switch (10A) would be used. An exemplary rotary paddle switch is a K-TEK Model KP Rotating Paddle Switch. Other rotary paddle switches may also be used. The signal from the laser was fed into a PLC system (28) which fed an auger system (not shown) to load the hopper (20) above the flap valves (2) and then initiate the flap valve sequence. A blower (21) was used to create a vacuum on the gasifier outlet to promote an air flow through the central air inlet (3). The gasifier was initially brought up to temperature using charcoal as a fuel. Other fuels and techniques may also be used to bring the gasifier up to the desired operating temperature. Once the gasifier was up to the desired operating temperature (e.g., 600 to 1200° C.) the wood pellets were introduced into the system. The blower was set to withdraw 300 SCFM (standard cubic feet per minute) of syngas from the system. Initially, the gasifier operated in a stable manner, with temperatures and syngas composition in the normal range. After 50 minutes of operation localized "hot spots" began to form within the bed. The syngas quality began to reduce whilst the carbon dioxide production rate increased. The blower was turned off and the system was allowed to cool. After the system had cooled, the bed was examined and localized low spots in the bed were identified. The grate under these low spots was found to have sustained thermal damage due to localized combustion occurring there.

Example 2

The same test as described above was conducted utilizing wood chips as the fuel source. The system was found to be more unstable than the test described in Example 1. After the test a large peak was found under the biomass feed point. Again damage had occurred to the grate under low points in the bed.

Example 3

A rotating paddle arrangement (5) was installed in the 50" ID gasifier described above. The system was externally driven using an electrical motor (22) and gearbox (23) arrangement. The motor was powered from a variable frequency drive (VFD) (not shown, but could be part of PLC (28)) to allow the effect of rotational speed to be investigated. The paddle (5) consisted of a solid 1" 304 stainless steel square bar which was connected via a yoke arrangement (not shown) to the drive shaft (not separately numbered). The paddle was arranged such that the top of the paddle was 1" below the level of the bed indicator laser (10). The paddle was set to rotate at approximately 1 RPM. The test described in Example 1 was repeated. The system was found to operate in a stable manner with consistent radial temperature profiles. A strong syngas was produced which showed little variation over the entire period (50 minutes) of the test. The system was operated for four hours after which time the flame front was found to have migrated to the top of the bed. The system had then become top stabilized, after which point the gas composition became oscillatory and related to feed addition times.

A second cause of instability inherent to stratified downdraft gasifiers results from the tendency of the flame front to migrate within the bed. If the flame front migrates toward the top of the bed the oxidant to biomass ratio there allows for combustion of the biomass products there. The carbon dioxide and water can be reduced in the lower sections to produce syngas. When the system becomes "top stabilized" a large amount of "fines" (fine particular matter or ash) can be rapidly accumulated towards the top of the bed. These fines can result in a rapid increase in the pressure drop across the bed. For processes fed in a semi-batch method, large oscillations in gas chemistry, composition and tar loadings were seen to be synchronized to biomass addition times.

Figure 2:
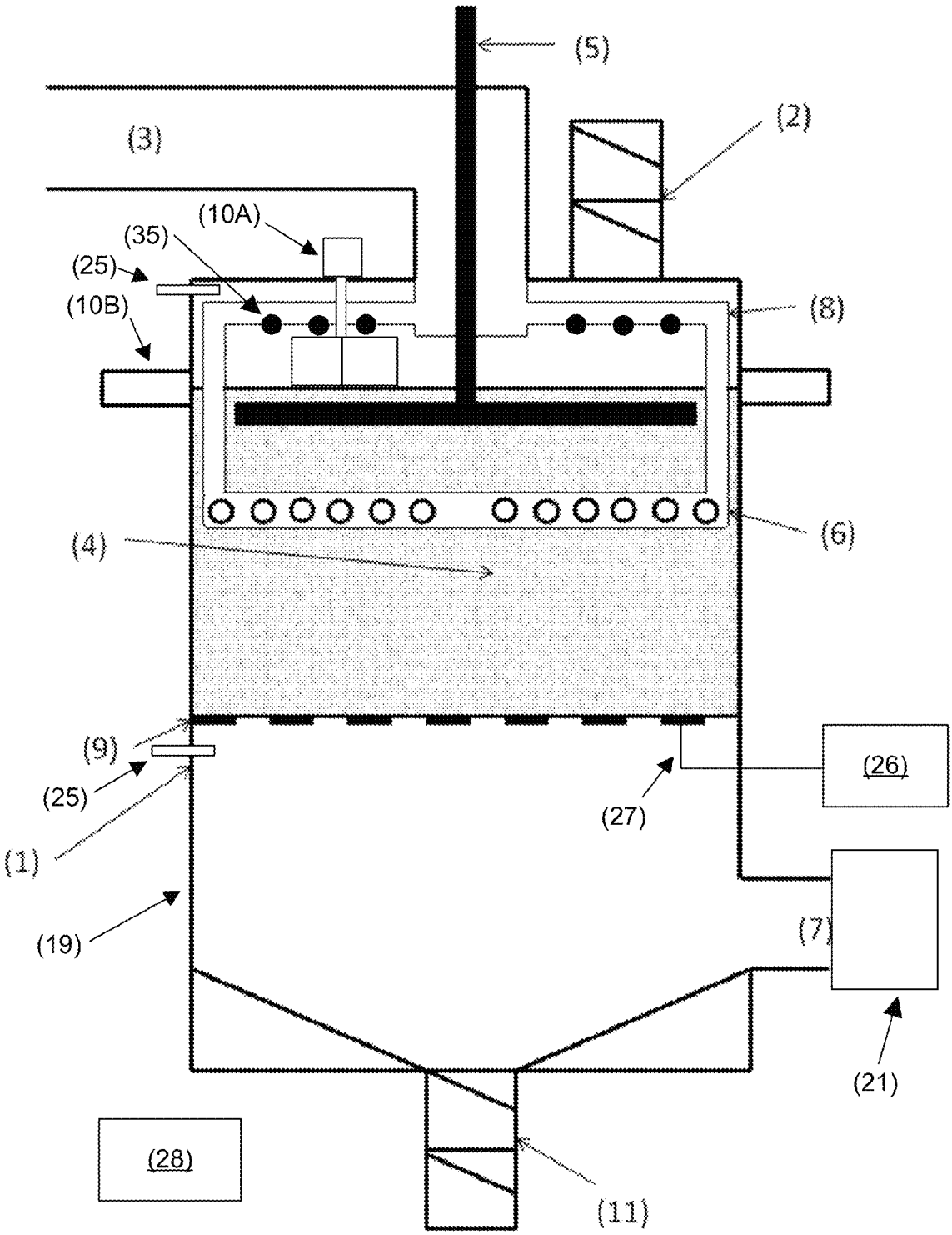
FIG. 2 is a schematic of a downdraft gasifier with an in-bed air distributor.

FIG. 2 is a schematic of a downdraft gasifier with an in-bed air distributor. In the figure air distribution pipes (8) are used to allow the passage of the oxidant from the inlet (3) to the in-bed oxidant distributor (6). The in-bed distributions can be fed a number of ways, including vertical air distribution pipes from above, below or directly through the gasifier wall. A large singular pipe can also be used.

Figure 3:
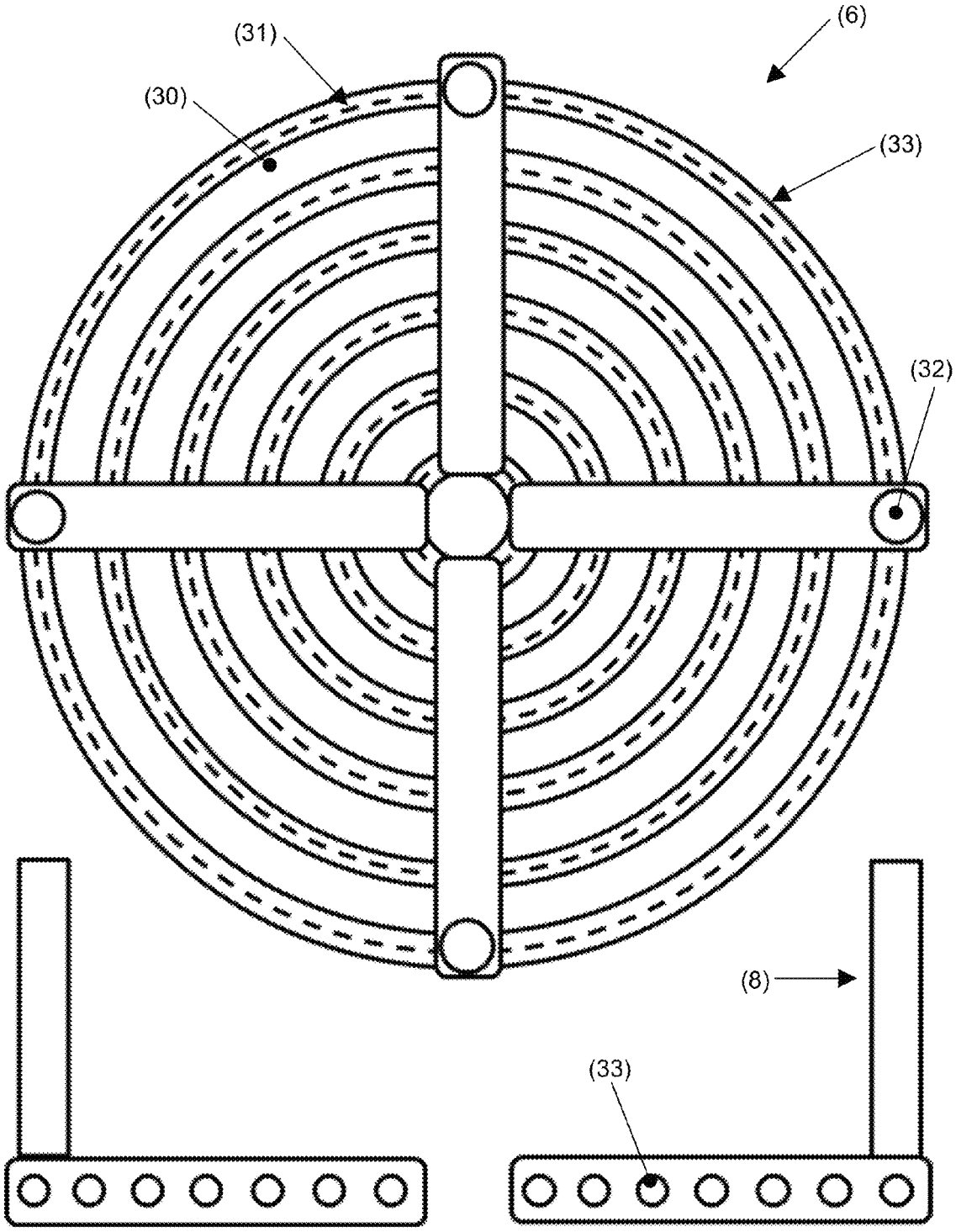
FIG. 3 illustrates top and side views of an exemplary in-bed air distributor design.

FIG. 3 illustrates top and side views of an exemplary in-bed air distributor design (6). The distributor consists of a structure which preferably spans the entire cross section of the bed. The structure contains large voids (30) through which the biomass can readily flow. The structure contains a number of air injection nozzles (31). The size and location of the nozzles are designed to introduce an even flow of oxidant per unit area of cross sectional bed area. Any structure can which does not impede the downward flow of biomass and that the nozzle density is preferably such that each nozzle supplies air to 1 $in^2$ to 30 $in^2$ of bed cross sectional area. A paddle (5) can be used to aid in material flow through the distributor structure. The nozzle inner diameter should be in the range of 1/16" to 1". The injection velocity is preferably in the range of 30-300 ft/s, and more preferably in the range 70-170 ft/s. The distributor should be constructed such that the pressure drop through the nozzle is preferably 2 times to 30 times the pressure drop for the gas to flow from the point of entry into the distributor to the location of the nozzle.

In a preferred embodiment the distributor consists of 5 to 7 concentric rings (33) fed from four diametrically opposed feed addition points (32). 220 5/16" OD holes (31) are drilled into the rings. At a flow rate of 1000 SCFM the pressure drop through the distributor is less than 0.3 pounds per square inch. The nozzles can be orientated to direct the gas directly downwards or the nozzle can be inclined to direct the gas at a slight angle from directly downward. A mixture of orientations can also be used.

Figure 4:
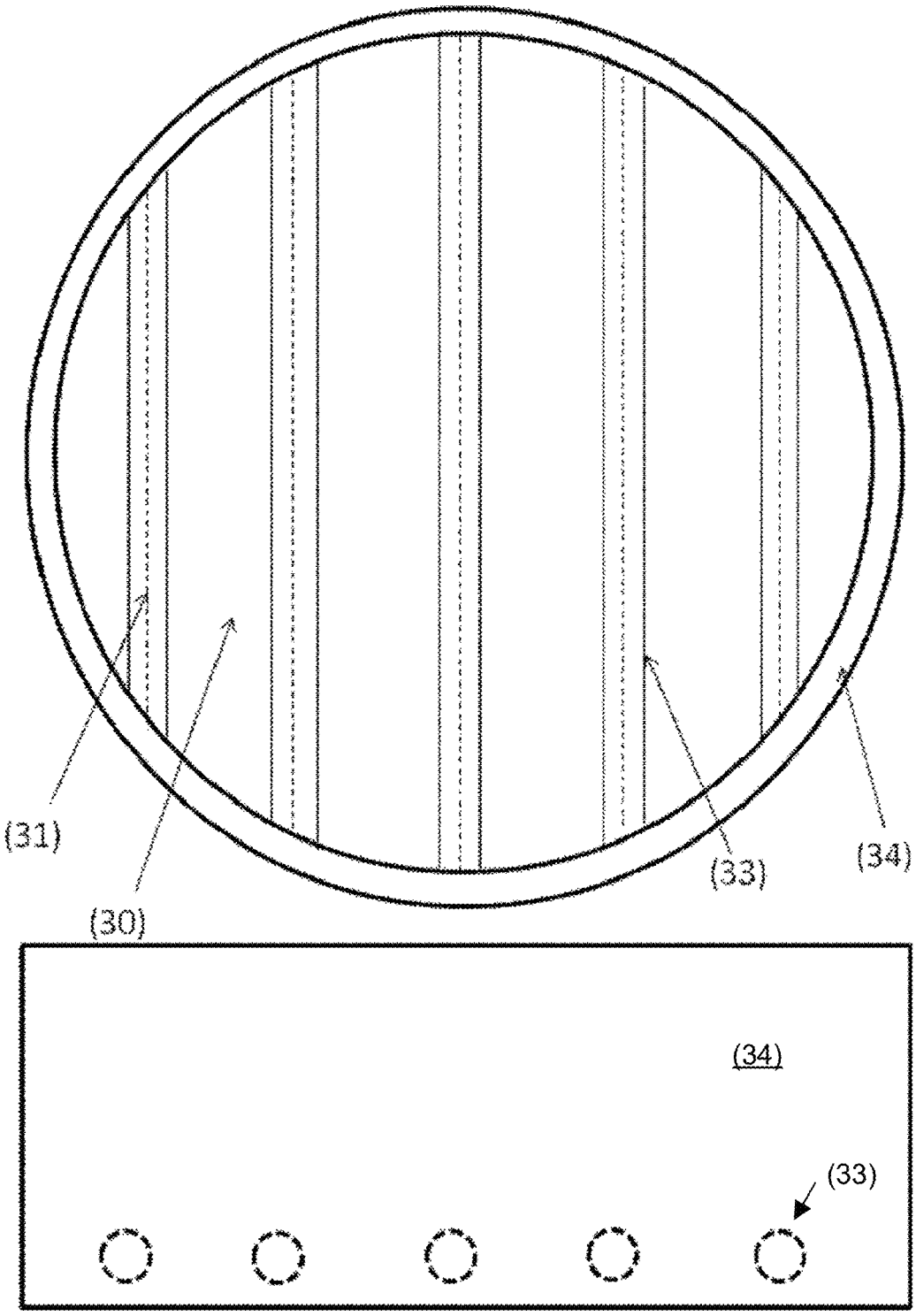
FIG. 4 illustrates top and side views of another exemplary in-bed air distributor design.

FIG. 4 illustrates top and side views of another exemplary in-bed air distributor design. In this case the air distributor (6) consists of parallel pipes (33) with air distribution nozzles (31) located along the length. Air is fed to the air distributor via an annulus (34). The annulus is preferably constructed via a tube-in-tube arrangement, that is, a outer tube forming an outer wall and an inner tube forming an inner wall, with the air passing through the central cavity formed between these two walls. The tube-in-tube arrangement is sealed at the top and bottom other than for the air inlet openings (32) (not shown in this figure) into the annulus at the top, and the air distribution pipes (33) in the lower section. Nozzles (not shown) may also be located in the inner tube to enhance air distribution to the inner wall of the gasifier vessel. A step or inset (not shown) can be made in the inner refractory wall of the gasifier to accommodate the vertical section of the tube-in-tube downpipe so that the interior of the gasifier presents a substantially uniform cross-section from top to bottom.

In the schematic of FIG. 2 a blower (21) located on the gasifier exit piping or gas exit port (7) is used to create a vacuum at the gasifier exit (7) to promote the air flow through the distributor. It is also possible that an external positive pressure blower can be used to overcome the pressure drop associated with the distributor and potentially part of the pressure drop associated with the flow through the bed. A number of optional air nozzles (35) can also be located in the distributor feedpipes (8) located in the gasifier headspace. In this case part of the oxidant flows through the entire bed and part is injected within the bed itself. The size ratio of the nozzles can be used to direct between 0% and 100% into the bed directly. In the preferred embodiment 80-90% of the oxidant is directed into the lower bed distributor.

A third inherent cause of instability in downdraft gasifiers is related to unstable flow of ash and char on and through the grate (9). If material does not flow through the grate in an even manner the particle size distribution across the cross sectional area at a height just above the grate will become very broad. Cross sectional areas with low rates of biomass passage through the grate will tend to accumulate a large amount of fines. Areas in the cross-sections which exhibit smaller than median particle sizes will have a reduced flow of oxidant there due to an increase in pressure drop through the fine material. The loss of oxidant flow will reduce the rate of biomass consumption in these regions. The result of the reduced cross sectional area for flow results in an increase in pressure drop across the system and can eventually result in the need to shut down the system down due to a plugged bed.

Figure 5:
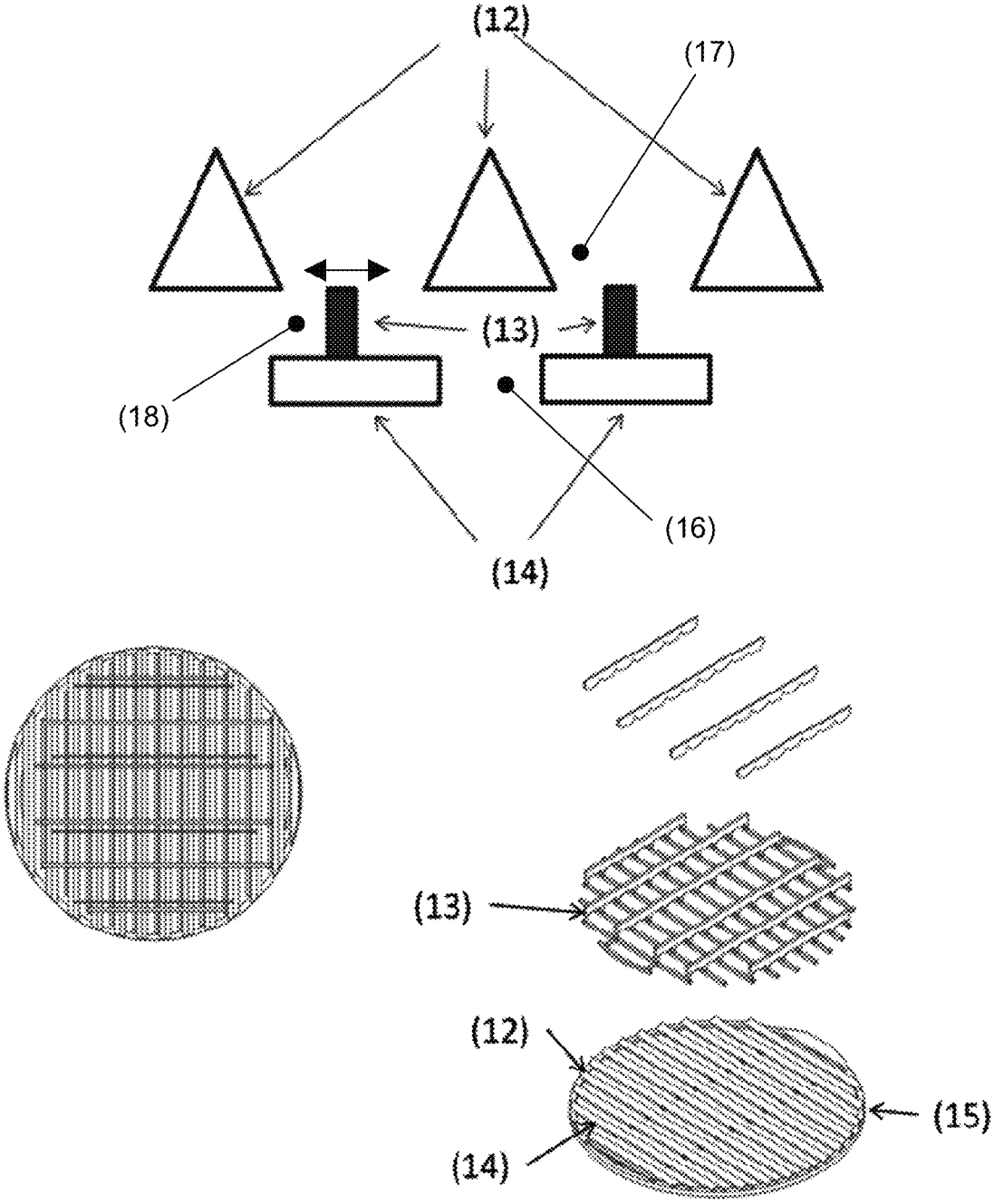
FIG. 5 illustrates the components and construction of an exemplary actuated sliding grate arrangement.

FIG. 5 illustrates the components and construction of an exemplary actuated sliding grate arrangement. The grate consists of lower flat plate sections (14) and upper canopy sections (12). An outer spacer (15) is used to maintain gap spacing between the circumference of the grate and the inside of the hopper. Canopy sections (12) are separated from each other by gaps (17), and flat plate sections (14) are separated by gaps (16). The size of the gaps (16) and the upper canopy sections (12) is such that, when the grate is observed from above, no passageways through the grate can be seen because the upper canopy sections (12) are directly above and conceal the gaps (16) in the lower flat plate section (14). A sliding paddle (13) arrangement sits on top of the lower flat plate section (14), the sliding paddles also being separated by gaps (not numbered separately). Each sliding paddle (13) moves laterally (as shown on the page) across the width of its corresponding lower plate section (14) and thereby moves the ash and char along the lower plate until it exits through the perpendicular slot (18) formed between the upper canopy and lower flat plate by the sliding paddle (13). The amount of material to be passed with each stroke can be adjusted by selecting the height of the paddle and controlling the length of each actuation stroke. The gap size can be adjusted to suite the size and nature of the ash/char solids at that location. Also, the size of the ash/char solids can be controlled by adjusting the lateral movement of the paddle. The larger the lateral movement the larger the size particle that will be passed, limited by, of course, the size of the gaps.

Preferably, the canopy sections (12) have a triangular shape and the plate sections (14) are generally in the shape of an inverted "T". Variations from these shapes are acceptable provided they meet the functional requirements discussed above.

An advantage of this arrangement is that the grate can be actively controlled to move a desired volume of ash material evenly from throughout the cross section of the bed. The actuation frequency can be controlled by temperature or pressure drop measurements from sensors (25) or related to the frequency of feed addition sequences. The grate also allows the gasifier to be operated in a char production mode. Here char is purposely withdrawn from the bed at a more rapid frequency than that forced by the process. This is a desirable mode when a source of activated carbon is required or when carbon is to be added to land or a landfill as a means of sequestering carbon. In this case the whole process can operate with a negative carbon footprint.

Example 4

A 50" ID stratified gasifier with off center 12' twin flap valves for biomass addition and a 6" central air oxidant inlet was used to gasify ¼" OD wood pellets. A tangential laser system (10) was used to indicate bed height and set to maintain the bed height at 24" from the top of the grate to the top of the bed. The signal from the laser was fed into a PLC system (28) which fed an auger system (not shown) to load the hopper ((20) in FIG. 1) above the flap valves (2) and then initiate the flap valve sequence. As previously mentioned, preferably, an infrared or microwave sensor would be used and, even more preferably, a rotary paddle switch would be used. The distributor illustrated in FIG. 3 was installed in the gasifier and positioned such that the top edge of the concentric rings was 6" below the bottom edge of the rotating paddle. The grate illustrated in FIG. 5 was positioned 3 feet above the bottom of the gasifier body. The paddle mechanism (13) was actuated through an external port (not shown) via an extension shaft (27). A motor (26), such as a pneumatic actuator capable of generating 5000 pounds of push or pull force, was used to move the paddle system (13). A tie rod (not shown) was used to connect the bottom section of the grate to an external fixed point to prevent the whole mechanism from being moved during paddle actuation. A blower (21) was used to create a vacuum on the gasifier outlet to promote an air flow through the 6" central air inlet (3). The gasifier was initially brought up to temperature using charcoal as a fuel. Other fuels can also be used. Once the gasifier was up to temperature the wood pellets were introduced into the system. The blower was set to withdraw 300 scfm of syngas from the system. The blower throughput was slowly increased from 300 scfm to 1400 scfm over a three hour period. The system was then held at a steady state for a further four hours. The grate was actuated each time a thermocouple (25) just above the in-bed distributor (6) began to show a temperature exceeding a predetermined temperature. Following each grate actuation the lower ash removal valves (11) were actuated to remove the ash/char mixture from the system. The system operated in a stable steady state, with minimal temperature or pressure drop oscillations.

In an alternative embodiment, the canopy section is fixed and the motor moves the plate sections.

The stability of a downdraft gasifier can thus be dramatically improved using one or more of the techniques disclosed herein. The techniques can also be used to produce gasifier systems with substantially higher energy output rates than those of traditional design. When all of the improvements are implemented a more even bed and air flow is produced, resulting in even gasification which occurs in a similar manner across the full cross sectional area of the gasifier bed.

The present invention enhances the quality of the environment by reducing the quantity of material going to landfills or that might otherwise simply be burned, reduces green house gas emission by more efficiently using materials to produce syngas, and conserves energy resources by providing a useful product, syngas, from materials that might otherwise be simply burned or tossed into a landfill to dispose of them.

The techniques or parts of the techniques can be applied to a number of different gasifier designs and therefore the examples set out herein illustrate several embodiments but should not be construed as limiting the scope of the invention in any manner.

Although various embodiments of the present invention have been described in detail herein, other variations may occur to those reading this disclosure without departing from the spirit of the present invention. Accordingly, the scope of the present invention is to be limited only by the claims.

The invention claimed is:

1. A downdraft gasifier comprising:

a body;

an air intake to allow air into the body;

a fuel feed inlet to allow the controlled introduction of fuel into the gasifier;

a first grate located inside the body and below the fuel feed inlet to support a bed of the fuel wherein the first grate comprises a plurality of elongate elements;

a second grate, located inside the body and below the first grate wherein the second grate comprises a plurality of elongate elements, the elongate elements of the second grate being substantially parallel to the elongate elements of the first grate;

a third grate, located inside the body and positioned between the first grate and the second grate, and being movable with respect to the first and second grates wherein the third grate comprises a plurality of elongate sliding paddles, a sliding paddle being on and parallel to a corresponding elongate element of the second grate, and being moveable across at least a portion of the corresponding elongate element of the second grate;

an actuator to move the third grate;

an in-bed air distribution system comprising a plurality of pipes with nozzles therein, located inside the body and above the first grate, to inject air within the bed;

a rotating paddle, located inside the body and above the first grate, to stir the bed;

a gas exit port located below the first grate; and an ash removal port below the second grate.

2. The downdraft gasifier of claim 1, wherein the air distribution system further comprises at least one pipe having nozzles therein to inject air above the bed.

3. The downdraft gasifier of claim 2, wherein the air distribution system injects approximately 10% of the air above the bed and 90% of the air within the bed.

4. The downdraft gasifier of claim 1, and further comprising a bed level sensor to control the fuel feed inlet to maintain the bed at a predetermined height.

5. The downdraft gasifier of claim 1, wherein:

the plurality of elongate elements of the first grate are substantially parallel, have a first width, and are separated from each other by a first predetermined distance;

the plurality of elongate elements of the second grate are substantially parallel, have a second width, and are separated from each other by a second predetermined distance;

the sliding paddles of the third grate are substantially centered on the corresponding elongate element of the second grate, and are moveable laterally across at least a portion of the second width of the corresponding elongate element of the second grate; and wherein the actuator further comprises a motor to laterally move the third grate.

6. The downdraft gasifier of claim 1, wherein an elongate element of the second grate and a sliding paddle of the third grate are arranged substantially in the form of an inverted "T".

7. The downdraft gasifier of claim 1, wherein an elongate element of the first grate has a predetermined shape and the predetermined shape is a triangle.

8. The downdraft gasifier of claim 5, wherein the first width is at least as great as the second predetermined distance, and the second width is at least as great as the first predetermined distance.

9. The downdraft gasifier of claim 1, wherein the actuator moves a sliding paddle laterally across a width of the corresponding elongate element of the second grate.

10. The downdraft gasifier of claim 1, wherein the actuator moves the sliding paddles in an oscillating motion across the elongate elements of the second grate.

11. The downdraft gasifier of claim 1 and further comprising a controller to activate said actuator.

12. The downdraft gasifier of claim 1 and further comprising a temperature sensor located above the in-bed air distribution system and a controller responsive to a signal from the temperature sensor to activate said actuator when said temperature is above a predetermined temperature.

13. The downdraft gasifier of claim 1 and further comprising an exhaust fan to drawn in air through the air intake.

14. The downdraft gasifier of claim 1 and further comprising a motor to rotate the rotating paddle.

15. A downdraft gasifier comprising:

a body having a top and a bottom;

an air intake toward the top of the body to allow air into the body;

a fuel feed inlet located toward the top of the body to allow the introduction of fuel into the gasifier;

a first grate located inside the body and below the fuel feed inlet and the air inlet to support a bed of the fuel, the first grate comprising a plurality of substantially parallel elongate elements, the elongate elements having a first width and being separated from each other by a first predetermined distance;

a second grate, located inside the body and below the first grate, the second grate comprising a plurality of substantially parallel elongate elements, the elongate elements having a second width and being separated from each other by a second predetermined distance, the elongate elements of the second grate being substantially parallel to the elongate elements of the first grate;

a third grate, located inside the body and positioned between the first grate and the second grate, and being movable with respect to the first and second grates, the third grate comprising a plurality of substantially parallel elongate slider elements, a slider element being substantially centered on and parallel to a corresponding elongate element of the second grate, and being moveable laterally across at least a portion of the second width of the corresponding elongate element of the second grate;

an actuator to move the third grate laterally across the second grate;

a rotating paddle, located inside the body and above the grate, to stir the bed;

a gas exit port located below the grate; and an ash removal port toward the bottom of the body.

16. The downdraft gasifier of claim 15, wherein an elongate element of the second grate and a slider element of the third grate are arranged substantially in the form of an inverted "T".

17. The downdraft gasifier of claim 15, wherein an elongate element of the first grate has a predetermined shape and the predetermined shape is a triangle.

18. The downdraft gasifier of claim 15, and further comprising a bed level sensor to control the fuel feed inlet to maintain the bed at a predetermined height.

19. The downdraft gasifier of claim 15, wherein the first width is at least as great as the second predetermined distance, and the second width is at least as great as the first predetermined distance.

20. The downdraft gasifier of claim 15, wherein the actuator moves a slider element laterally across the width of the corresponding elongate element of the second grate.

21. The downdraft gasifier of claim 15, wherein the actuator moves the slider elements in an oscillating motion across the elongate elements of the second grate.

22. The downdraft gasifier of claim 15 and further comprising a controller to activate said actuator.

23. The downdraft gasifier of claim 15 and further comprising a temperature sensor located above the bed and a controller responsive to a signal from the temperature sensor to activate said actuator when said temperature is above a predetermined temperature.

24. The downdraft gasifier of claim 15 and further comprising a motor to rotate the rotating paddle.

25. A downdraft gasifier comprising:

a body;

an air intake to allow air into the body;

a fuel feed inlet to allow introduction of fuel into the body;

a gas exit port to remove gas from the body;

an ash removal port to remove ash from the body;

a grate assembly, wherein the grate assembly is: inside the body, below the air intake, below the fuel feed inlet, above the gas exit port, and above the ash removal port, and wherein the grate assembly comprises:

a first grate comprising a plurality of elongate elements, the elongate elements having a first width and being separated from each other by a first predetermined distance;

a second grate comprising a plurality of elongate elements, the elongate elements having a second width and being separated from each other by a second predetermined distance, the elongate elements of the second grate being substantially parallel to the elongate elements of the first grate; and a third grate, positioned between the first grate and the second grate, and being movable with respect to the first and second grates, the third grate comprising a plurality of elongate slider elements, a slider element being substantially on and parallel to a corresponding elongate element of the second grate, and being moveable laterally across at least a portion of the second width of the corresponding elongate element of the second grate.

26. The downdraft gasifier of claim 25, wherein an elongate element of the first grate has a predetermined shape and the predetermined shape is a triangle.

27. The downdraft gasifier of claim 25, and further comprising a bed level sensor to control the fuel feed inlet to maintain the bed at a predetermined height.

28. The downdraft gasifier of claim 25, wherein the first width is at least as great as the second predetermined distance, and the second width is at least as great as the first predetermined distance.

29. The downdraft gasifier of claim 25, wherein the slider elements move in an oscillating motion across the elongate elements of the second grate.

30. The downdraft gasifier of claim 25, wherein an elongate element of the second grate and a slider element of the third grate are arranged substantially in the form of an inverted "T".

* * * * *